US010910759B2

(12) United States Patent
Naito et al.

(10) Patent No.: US 10,910,759 B2
(45) Date of Patent: Feb. 2, 2021

(54) CONNECTOR

(71) Applicant: JAPAN AVIATION ELECTRONICS INDUSTRY, LIMITED, Tokyo (JP)

(72) Inventors: Takeharu Naito, Tokyo (JP); Kimiaki Saitou, Tokyo (JP); Yukiko Sato, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/640,031

(22) PCT Filed: Aug. 3, 2018

(86) PCT No.: PCT/JP2018/029230
§ 371 (c)(1),
(2) Date: Feb. 18, 2020

(87) PCT Pub. No.: WO2019/069551
PCT Pub. Date: Apr. 11, 2019

(65) Prior Publication Data

US 2020/0244000 A1 Jul. 30, 2020

(30) Foreign Application Priority Data

Oct. 5, 2017 (JP) ..... 2017-195058

(51) Int. Cl.
*H01R 13/506* (2006.01)

(52) U.S. Cl.
CPC ..... *H01R 13/506* (2013.01)

(58) Field of Classification Search
CPC ..... H01R 13/6594; H01R 13/506
See application file for complete search history.

(56) References Cited

U.S. PATENT DOCUMENTS 7,556,531 B2 7/2009 Takeuuchi et al.
9,680,254 B1 6/2017 Nishikata et al.
(Continued)

FOREIGN PATENT DOCUMENTS

CN 201549640 U 8/2010
CN 205565124 U 9/2016
(Continued)

OTHER PUBLICATIONS

International Search Report (ISR) dated Nov. 6, 2018 (and English translation thereof) issued in International Application No. PCT/JP2018/029230.
(Continued)

*Primary Examiner* — Ross N Gushi
(74) *Attorney, Agent, or Firm* — Holtz, Holtz & Volek PC

(57) ABSTRACT

A connector includes a plurality of contacts, a holding member and a shell. The holding member has a main portion and a tongue portion. The main portion includes three or more positioned portions. The shell is formed with a hole and three or more positioning protrusions. The hole has a closed periphery on a surface of the shell. The hole pierces the shell in a first direction perpendicular to a mating direction. The positioning protrusions occupy zones, respectively, in the mating direction. The zones overlap with each other in the mating direction. The positioning protrusions include a first positioning protrusion and two second positioning protrusions. The first positioning protrusion forms a part of the closed periphery of the hole. The first positioning protrusion faces the hole. When the shell is viewed alone, at least one of the second positioning protrusions is visible through the hole.

6 Claims, 9 Drawing Sheets

(56) References Cited

U.S. PATENT DOCUMENTS

| | | | |
|---|---|---|---|
| 9,812,826 | B2 | 11/2017 | Yu et al. |
| 9,831,615 | B2 | 11/2017 | Saito et al. |
| 10,103,491 | B2 | 10/2018 | Ju |
| 10,103,492 | B2 | 10/2018 | Ju |
| 10,109,956 | B2 | 10/2018 | Ju |
| 10,243,302 | B2 | 3/2019 | Ju |
| 2008/0242142 | A1 | 10/2008 | Takeuuchi et al. |
| 2016/0064879 | A1 | 3/2016 | Yen et al. |
| 2017/0149172 | A1 | 5/2017 | Nishikata et al. |
| 2017/0222374 | A1 | 8/2017 | Saito et al. |
| 2017/0237195 | A1 | 8/2017 | Oguro |
| 2017/0250508 | A1 | 8/2017 | Yu et al. |
| 2018/0097298 | A1 | 4/2018 | Ju |

FOREIGN PATENT DOCUMENTS

| | | | |
|---|---|---|---|
| CN | 106856277 | A | 6/2017 |
| CN | 206271936 | U | 6/2017 |
| CN | 107039806 | A | 8/2017 |
| CN | 206461181 | U | 9/2017 |
| JP | 2008243689 | A | 10/2008 |
| JP | 2009064676 | A | 3/2009 |
| JP | 3198932 | U | 7/2015 |
| JP | 2016100145 | A | 5/2016 |
| JP | 2017098052 | A | 6/2017 |
| JP | 2017147070 | A | 8/2017 |
| TW | 201731176 | A | 9/2017 |

OTHER PUBLICATIONS

Japanese Office Action dated Oct. 31, 2018 (and English translation thereof) issued in Japanese Patent Application No. 2017-195058.

Taiwanese Office Action dated Sep. 18, 2019 (and English translation thereof) issued in Taiwanese Application No. 107127360.

Written Opinion of the International Searching Authority dated Nov. 6, 2018 issued in International Application No. PCT/JP2018/029230.

Chinese Office Action (and English language translation thereof) dated Sep. 21, 2020 issued in counterpart Chinese Application No. 201880055584.9.

CONNECTOR

TECHNICAL FIELD

This invention relates to a connector mateable with a mating connector.

BACKGROUND ART

Referring to FIGS. 16 and 17, Patent Document 1 discloses a connector 900 which is mateable with a mating connector 950 along a mating direction (X-direction). The connector 900 comprises a plurality of contacts 910, a holding member 920 and a shell 930. The holding member holds the plurality of contacts 910. The holding member 920 has a main portion 922 and a tongue portion 926. The tongue portion 926 has a flat plate shape. The main portion 922 is provided with four recesses (positioned portion) 923. The tongue portion 926 extends in the mating direction (X-direction) from the main portion 922. The shell 930 surrounds the holding member 920 in a plane perpendicular to the mating direction (X-direction). The shell 930 is formed with four positioning protrusions 932. Each of the positioning protrusions 932 protrudes inward of the shell 930. In the mating direction (X-direction), zones occupied by the positioning protrusions 932, respectively, overlap with each other. The positioning protrusions 932 are received in the recesses 923, respectively.

PRIOR ART DOCUMENTS

Patent Document(s)

Patent Document 1: JP A 2009-64676

SUMMARY OF INVENTION

Technical Problem

In the connector 900 of Patent Document 1, there is a possibility that, if the positioning protrusions 932 are deviated from each other in the mating direction (X-direction), an end of the tongue portion 926 of the holding member 920 is directed upward or downward when the shell 930 is assembled with the holding member 920.

It is therefore an object of the present invention to provide a connector which enables deviations of positions of positioning protrusions in a mating direction to be checked.

Solution to Problem

An aspect of the present invention provides a connector which is mateable with a mating connector along a mating direction. The connector comprises a plurality of contacts, a holding member and a shell. The holding member holds the plurality of contacts. The holding member has a main portion and a tongue portion. The tongue portion has a flat plate shape. The main portion is provided with three or more positioned portions. The tongue portion extends in the mating direction from the main portion. The shell surrounds, at least in part, the holding member in a plane perpendicular to the mating direction. The shell is formed with a hole and three or more positioning protrusions. The hole has a closed periphery on a surface of the shell. The hole pierces the shell in a first direction perpendicular to the mating direction. Each of the positioning protrusions protrudes inward of the shell. The positioning protrusions occupy zones, respectively, in the mating direction. The zones overlap with each other in the mating direction. The positioning protrusions are brought into abutment with the positioned portions, respectively, in the mating direction. The positioning protrusions include a first positioning protrusion and two second positioning protrusions. The first positioning protrusion forms a part of the closed periphery of the hole. The first positioning protrusion faces the hole. When the shell is viewed alone, at least one of the second positioning protrusions is visible through the hole.

Advantageous Effects of Invention

In the connector of the present invention, the shell is formed with the hole and the three or more positioning protrusions which include the first positioning protrusion and the two second positioning protrusions. Additionally, in the connector of the present invention, the first positioning protrusion forms the part of the closed periphery of the hole. Furthermore, in the connector of the present invention, when the shell is viewed alone, at least one of the second positioning protrusions is visible through the hole. Accordingly, deviations of positions of the positioning protrusions in the mating direction can be checked through the hole of the shell.

Thus, if the positioning protrusions are deviated from each other in the mating direction upon manufacture of a prototype of the shell alone in an assembly process of the connector of the present invention, a metal mold can be adjusted so that the deviations of the positioning protrusions are reduced after the deviations of the positioning protrusions are checked through the hole of the shell. In addition, the deviations of the positions of the positioning protrusions in the mating direction can be prevented if the shell is formed by pressing in the adjusted metal mold. Consequently, an attitude of the tongue portion of the holding member in the shell can be appropriately fixed when the shell is assembled with the holding member.

An appreciation of the objectives of the present invention and a more complete understanding of its structure may be had by studying the following description of the preferred embodiment and by referring to the accompanying drawings.

DESCRIPTION OF EMBODIMENTS

Figure 1:
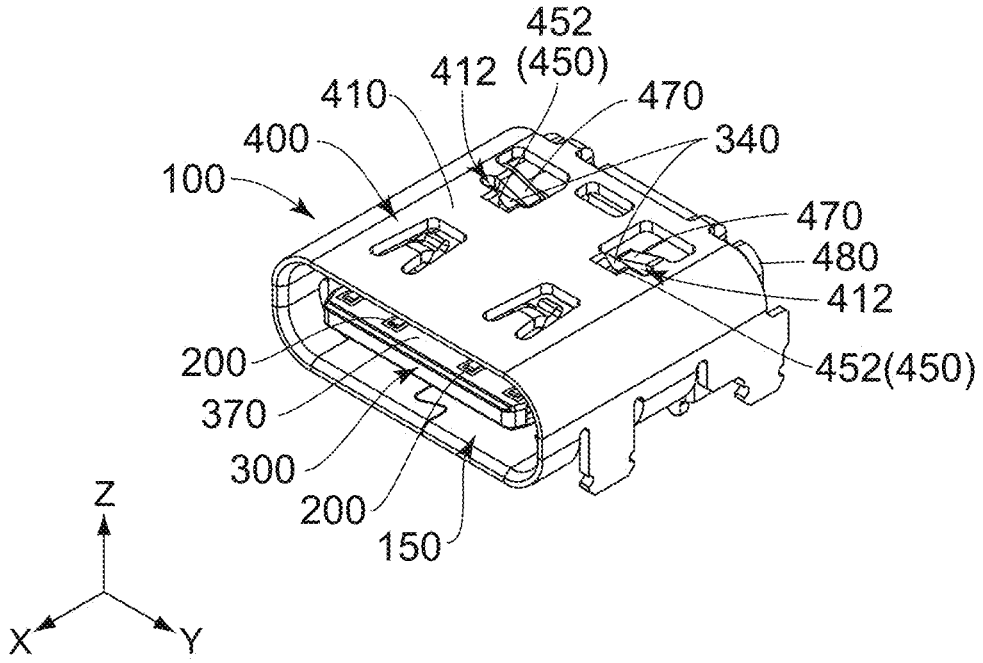
FIG. 1 is a perspective view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

Referring to FIGS. 1 to 6, a connector 100 according to an embodiment of the present invention is mateable with a mating connector (not shown) along a mating direction. In the present embodiment, the mating direction is an X-direction. The mating direction is also referred to as a front-rear direction. Specifically, it is assumed that forward is a positive X-direction while rearward is a negative X-direction.

As shown in FIGS. 1 to 6, the connector 100 of the present embodiment comprises a holding member 300, a plurality of contacts 200, a midplate 250 and a shell 400.

Figure 4:
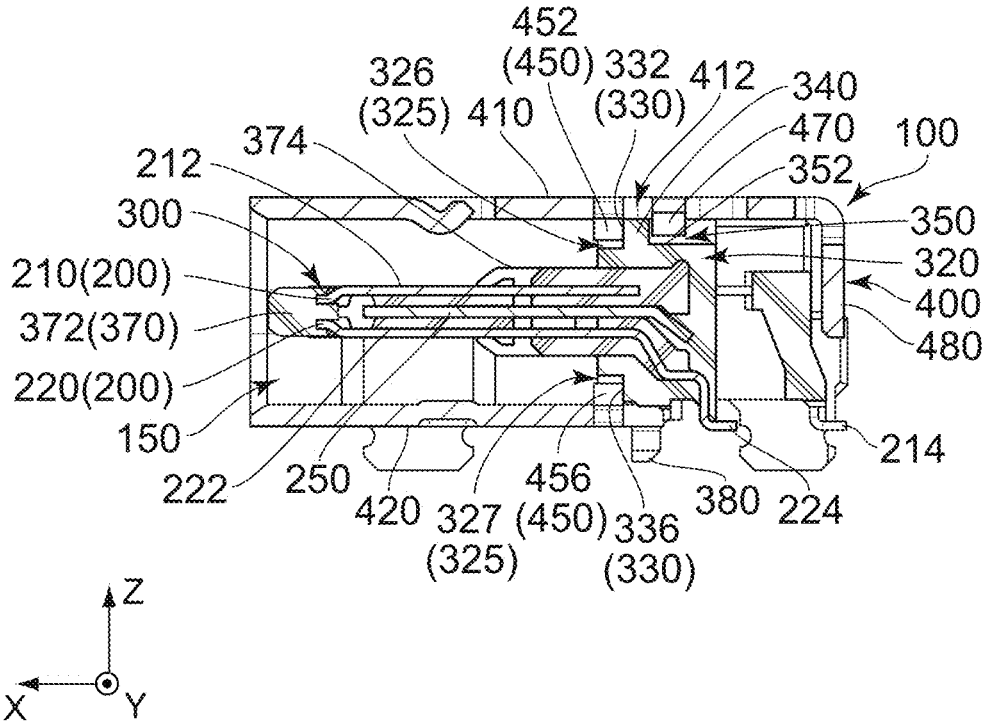
FIG. 4 is a cross-sectional view showing the connector of FIG. 3, taken along line A-A.
Figure 5:
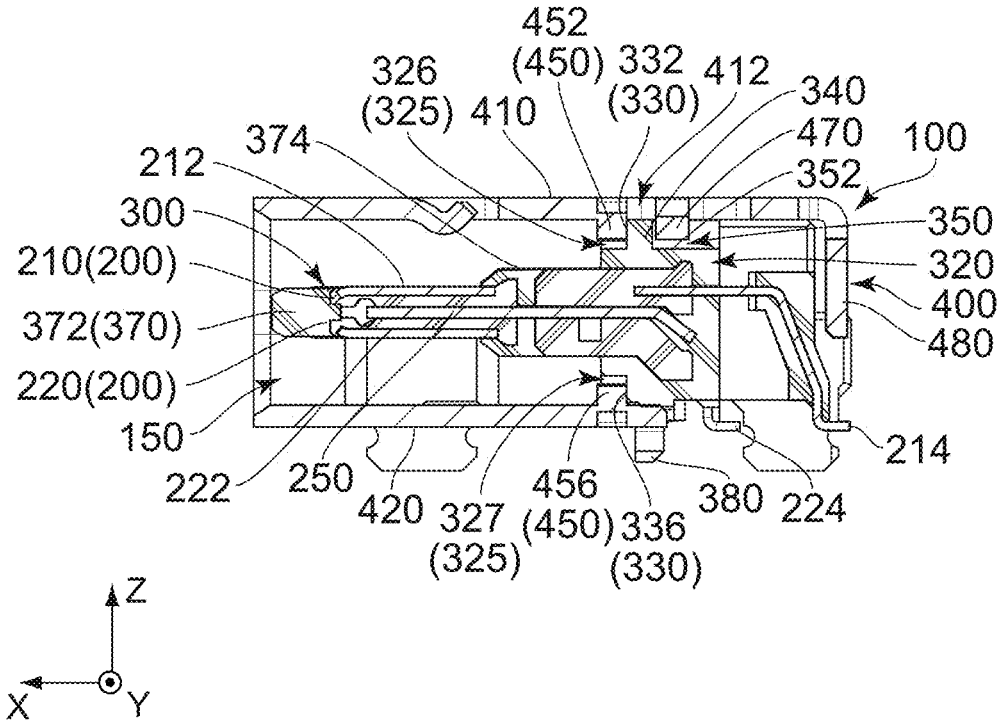
FIG. 5 is a cross-sectional view showing the connector of FIG. 3, taken along line B-B.

As shown in FIGS. 4 and 5, the holding member 300 of the present embodiment is attached and fixed to the shell 400. A method of attaching the holding member 300 to the shell 400 is described later.

Figure 9:
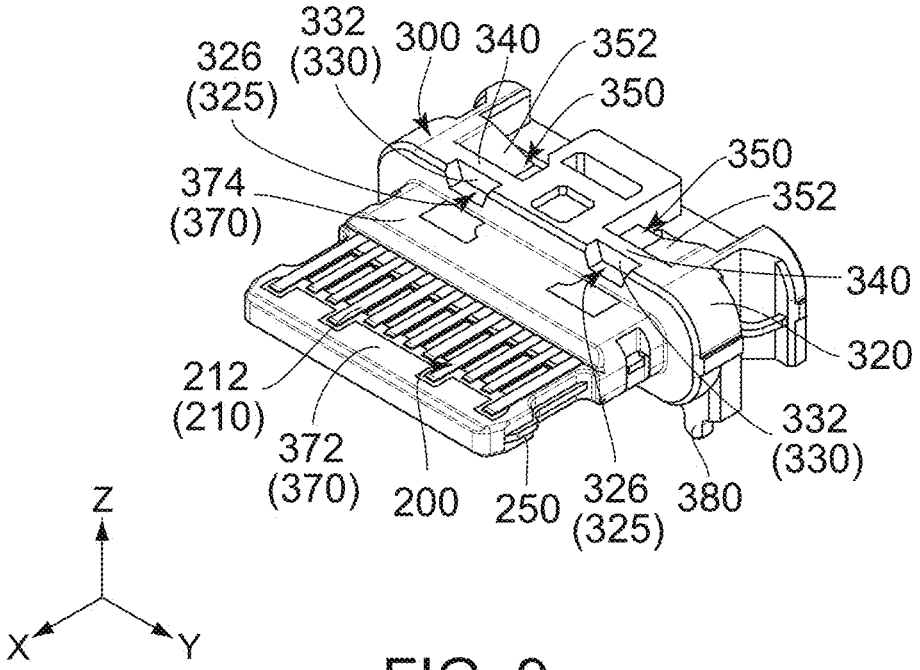
FIG. 9 is a perspective view showing a structure consisting of a holding member, contacts and a midplate which are included in the connector of FIG. 1.
Figure 10:
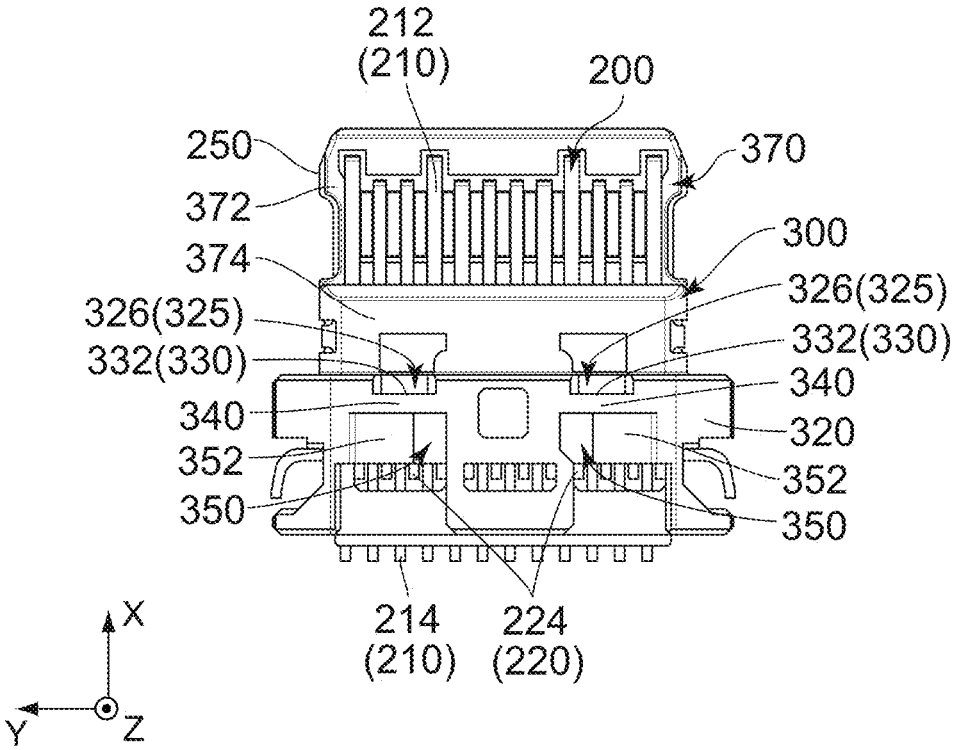
FIG. 10 is a top view showing the structure of FIG. 9.
Figure 11:
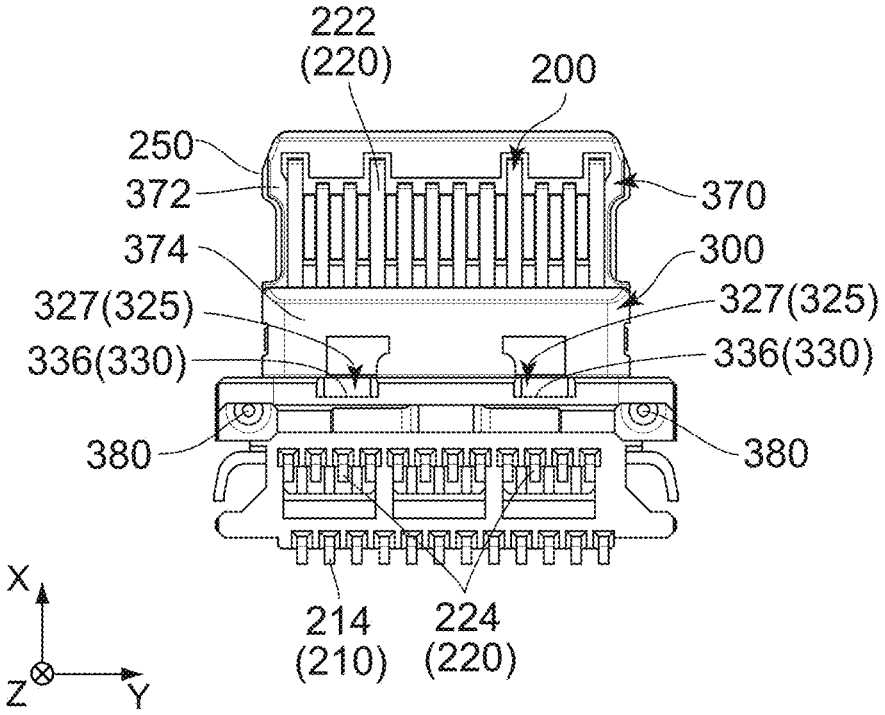
FIG. 11 is a bottom view showing the structure of FIG. 9.

Referring to FIGS. 9 to 11, the holding member 300 of the present embodiment is made of insulator. The holding member 300 has a main portion 320, a tongue portion 370 and two leg portions 380. The tongue portion 370 has a flat plate shape.

Figure 2:
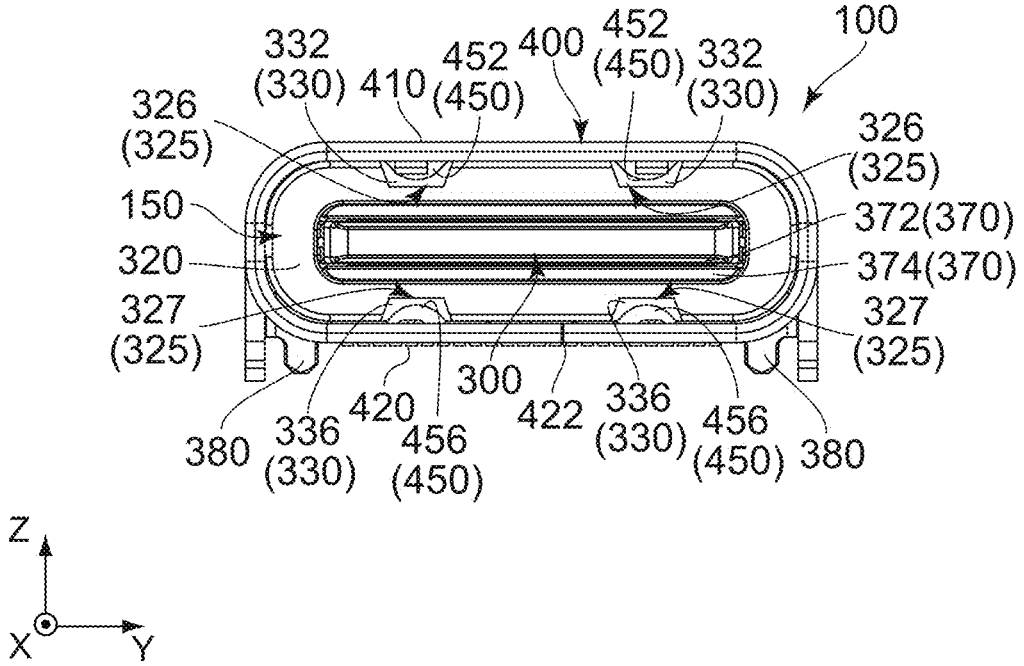
FIG. 2 is a front view showing the connector of FIG. 1.

As shown in FIG. 2, when the holding member 300 is viewed from the front thereof, the main portion 320 of the present embodiment has a rounded rectangular shape having two linear sides and two arc-shaped sides. The two linear sides of the rounded rectangular shape of the main portion 320 face each other in a first direction perpendicular to the front-rear direction. The two arc-shaped sides of the rounded rectangular shape of the main portion 320 face each other in a second direction perpendicular to both the front-rear direction and the first direction. In the present embodiment, the first direction is a Z-direction while the second direction is a Y-direction. The first direction is also referred to as an up-down direction. It is assumed that upward is a positive Z-direction while downward is a negative Z-direction. As shown in FIGS. 9 to 11, the main portion 320 of the present embodiment has a block-like shape extending long in the second direction.

Referring to FIGS. 9 to 11, the main portion 320 of the present embodiment is provided with four recesses 325, two held portions 340 and two holding lug accommodating portions 350.

As shown in FIGS. 9 to 11, each of the recesses 325 of the present embodiment is recessed rearward in the front-rear direction. Each of the recesses 325 has a rear wall perpendicular to the front-rear direction, and the rear wall functions as a positioned portion 330. In other words, the main portion 320 of the present embodiment is provided with four of the positioned portions 330. The four positioned portions 330 are positioned at positions same as each other in the mating direction, or in the front-rear direction. The four positioned portions 330 form a reference surface perpendicular to the front-rear direction. In addition, the present invention is not limited thereto. But, the main portion 320 should be provided with three or more of the positioned portions 330.

As shown in FIGS. 9 to 11, the recesses 325 of the present embodiment include first recesses 326 and second recesses 327. Each of the first recesses 326 is provided on an upper front end of the main portion 320. Each of the second recesses 327 is provided on a lower front end of the main portion 320.

As shown in FIGS. 9 to 11, each of the first recesses 326 of the present embodiment has a first positioned portion 332. In addition, each of the second recesses 327 of the present embodiment has a second positioned portion 336. Specifically, the positioned portions 330 of the present embodiment include two of the first positioned portions 332 and two of the second positioned portions 336. The first positioned portions 332 correspond to the second positioned portions 336, respectively. Referring to FIG. 2, each of the first positioned portions 332 is positioned above the second positioned portion 336 corresponding thereto in the up-down direction. Each of the first positioned portions 332 is positioned at a position same as that of the second positioned portion 336 corresponding thereto in the second direction.

As shown in FIGS. 9 and 10, each of the held portions 340 of the present embodiment has a flat plate shape extending in the up-down direction. Specifically, each of the held portions 340 has a front surface and a rear surface in the front-rear direction. The front surfaces of the held portions 340 function as the first positioned portions 332, respectively.

As shown in FIGS. 9 and 10, each of the holding lug accommodating portions 350 is recessed downward in the up-down direction. Each of the holding lug accommodating portions 350 has a slope 352 which extends downward and toward an inside of the main portion 320 in the second direction. The holding lug accommodating portions 350 correspond to the held portions 340, respectively. Each of the holding lug accommodating portions 350 is positioned rearward of the held portion 340 corresponding thereto in the front-rear direction.

As shown in FIGS. 9 to 11, the tongue portion 370 of the present embodiment extends in the mating direction, or in the front-rear direction, from the main portion 320. More specifically, the tongue portion 370 of the present embodiment extends forward from the front end of the main portion 320. The tongue portion 370 is perpendicular to the reference surface which is formed by the four positioned portions 330.

As shown in FIGS. 9 to 11, the tongue portion 370 of the present embodiment has a contact portion exposed portion 372 and a connecting portion 374. The contact portion exposed portion 372 has a flat plate shape perpendicular to the up-down direction. Specifically, the contact portion exposed portion 372 has an upper surface and a lower surface in the up-down direction. In the present embodiment, a plane perpendicular to the up-down direction is an XY-plane. The contact portion exposed portion 372 is positioned forward of the connecting portion 374 in the front-rear direction. Specifically, a rear end of the contact portion exposed portion 372 is connected with a front end of the connecting portion 374 in the front-rear direction. The connecting portion 374 has a substantially cuboid shape extending in the second direction. Referring to FIG. 2, when the holding member 300 is viewed from the front thereof, the connecting portion 374 has a rounded rectangular shape having two linear sides and two arc-shaped sides. The two linear sides of the rounded rectangular shape of the connecting portion 374 face each other in the up-down direction. The two arc-shaped sides of the rounded rectangular shape of the connecting portion 374 faces each other in the second direction. In the up-down direction, a size of the connecting portion 374 is greater than a size of the contact portion exposed portion 372. More specifically, an upper end of the connecting portion 374 is positioned above an upper end of the contact portion exposed portion 372 in the up-down direction. A lower end of the connecting portion 374 is positioned below a lower end of the contact portion exposed portion 372 in the up-down direction. The connecting portion 374 is positioned forward of the main portion 320 in the front-rear direction. Specifically, a rear end of the connecting portion 374 is connected with the front end of the main portion 320 in the front-rear direction. The upper end of the connecting portion 374 is positioned below a lower end of the first recess 326 of the main portion 320 in the up-down direction. The lower end of the connecting portion 374 is positioned above an upper end of the second recess 327 of the main portion 320 in the up-down direction. In the second direction, each of opposite ends of the connecting portion 374 is positioned inward of opposite ends of the main portion 320.

As shown in FIGS. 2, 9 and 11, the leg portions 380 of the present embodiment are positioned around the opposite ends, respectively, of the main portion 320 in the second direction. Each of the leg portions 380 of the present embodiment extends downward from the lower end of the main portion 320.

Each of the contacts 200 of the present embodiment is made of metal. As understood from FIGS. 4 and 5 as well as 9 to 11, each of the contacts 200 is embedded in the holding member 300 via insert-molding and is held thereby. In other words, the holding member 300 holds the plurality of contacts 200. Each of the contacts 200 of the present embodiment has a substantially L-like cross-section in a plane perpendicular to the second direction. In the present embodiment, the plane perpendicular to the second direction is an XZ-plane.

As shown in FIGS. 4, 5, 10 and 11, the contacts 200 of the present embodiment include a plurality of first contacts 210 and a plurality of second contacts 220.

As shown in FIG. 5, each of the first contacts 210 of the present embodiment has a first contact portion 212 and a first fixed portion 214. The first contact portion 212 has a plate-like shape. The first contact portion 212 is positioned around a front end of the first contact 210. The first fixed portion 214 is positioned at a rear end of the first contact 210. The first contact portion 212 of each of the first contacts 210 is exposed on the upper surface of the contact portion exposed portion 372 of the tongue portion 370 of the holding member 300. The first fixed portion 214 of each of the first contacts 210 is positioned in the vicinity of a rear end of a lower part of the connector 100.

As shown in FIG. 4, each of the second contacts 220 of the present embodiment has a second contact portion 222 and a second fixed portion 224. The second contact portion 222 has a plate-like shape. The second contact portion 222 is positioned around a front end of the second contact 220. The second fixed portion 224 is positioned at a rear end of the second contact 220. The second contact portion 222 of each of the second contacts 220 is exposed on the lower surface of the contact portion exposed portion 372 of the tongue portion 370 of the holding member 300. The second fixed portion 224 of each of the second contacts 220 is positioned forward of the first fixed portion 214 of any of the first contacts 210. The second fixed portion 224 of each of the second contacts 220 is positioned rearward of a rear end of the holding lug accommodating portion 350 of the main portion 320 of the holding member 300. The first fixed portions 214 of the first contacts 210 and the second fixed portions 224 of the second contacts 220 are positioned on a single XY-plane in the up-down direction.

Referring to FIGS. 4 and 5, the first contact portions 212 of the first contacts 210 and the second contact portions 222 of the second contacts 220 are brought into contact with mating contacts (not shown), respectively, of the mating connector (not shown) when the connector 100 and the mating connector (not shown) are mated with each other. In addition, the first fixed portion 214 of the first contact 210 and the second fixed portion 224 of the second contact 220 are portions which are configured to be soldered to wired patterns (not shown), respectively, of a circuit board (not shown) when the connector 100 is mounted on the circuit board (not shown).

The midplate 250 of the present embodiment is made of metal. As understood from FIGS. 4 and 5 as well as 9 to 11, the midplate 250 is embedded in the holding member 300 via insert molding and is held thereby. More specifically, the midplate 250 of the present embodiment has a substantially flat plate shape perpendicular to the up-down direction. The midplate 250 is held by the holding member 300 so as to be positioned between the first contacts 210 and the second contacts 220 in the up-down direction.

The shell 400 of the present embodiment is made of metal. As understood from FIGS. 1 to 6, the shell 400 surrounds the holding member 300 in a plane perpendicular to the mating direction, or to the front-rear direction. In the present embodiment, the plane perpendicular to the front-rear direction is a YZ-plane. In addition, the present invention is not limited thereto. But, the shell 400 should surround, at least in part, the holding member 300 in the plane perpendicular to the mating direction.

As shown in FIGS. 1 to 6, the shell 400 of the present embodiment has a first face 410 and a second face 420 which are opposite faces of the shell 400 in the up-down direction. Specifically, the first face 410 is an upper face 410 of the shell 400, and the second face 420 is a lower face 420 of the shell 400. Each of the first face 410 and the second face 420 is perpendicular to the up-down direction. A front end of the shell 400 of the present embodiment opens. In other words, the connector 100 has an opening 150 at its front end.

As shown in FIGS. 1 to 6, the shell 400 of the present embodiment is formed with two holes 412 and four positioning protrusions 450. In addition, the shell 400 of the present embodiment is provided with a joint 422, two holding lugs 470 and a rear wall 480. In addition, the present invention is not limited thereto. But, the shell 400 should be formed with the single hole 412 and three or more of the positioning protrusions 450.

As shown in FIGS. 1, 3, 4 and 5, each of the holes 412 of the present embodiment is formed on the first face 410 of the shell 400. In other words, the first face 410 of the shell 400 is formed with the two holes 412. Each of the holes 412 has a closed periphery on a surface of the shell 400. Each of the holes 412 pierces the shell 400 in the first direction, or in the up-down direction. More specifically, each of the holes 412 has the closed periphery on a surface of the first face 410 of the shell 400. Each of the holes 412 pierces the first face 410 of the shell 400 in the up-down direction. An inner side of the periphery of the hole 412 in the second direction has a substantially linear shape extending in the front-rear direction.

Referring to FIGS. 2, 4 and 5, each of the positioning protrusions 450 of the present embodiment protrudes inward of the shell 400. More specifically, each of the positioning protrusions 450 of the present embodiment protrudes inward of the shell 400 in the up-down direction. The positioning protrusions 450 occupy zones, respectively, in the mating direction, or in the front-rear direction. The zones overlap with each other in the mating direction, or in the front-rear direction. More specifically, the positioning protrusions 450 are positioned at positions same as each other in the mating direction, or in the front-rear direction.

Referring to FIGS. 2, 4 and 5, the positioning protrusions 450 of the present embodiment are brought into abutment with the positioned portions 330 of the recesses 325, respectively, of the main portion 320 of the holding member 300 in the mating direction, or in the front-rear direction. More specifically, rear ends of the four positioning protrusions 450 and the four positioned portions 330 are positioned substantially on a single YZ-plane in the front-rear direction. Since the tongue portion 370 is perpendicular to the reference surface which is formed by the four positioned portions 330 as described above, an attitude of the tongue portion 370 of the holding member 300 in the shell 400 can be appropriately fixed.

Referring to FIGS. 2, 4 and 5, the positioning protrusions 450 of the present embodiment include two first positioning protrusions 452 and two second positioning protrusions 456. In addition, the present invention is not limited thereto. But, the positioning protrusions 450 should include the single first positioning protrusion 452 and the two second positioning protrusions 456. In other words, the shell 400 should have the single first positioning protrusion 452 and the two second positioning protrusions 456.

As shown in FIGS. 1 to 5, each of the first positioning protrusions 452 of the present embodiment is formed on the first face 410 of the shell 400. The first positioning protrusions 452 form parts of the closed peripheries of the holes 412, respectively. Each of the first positioning protrusions 452 faces the hole 412 corresponding thereto. More specifically, a rear edge of each of the first positioning protrusions 452 forms a part of a front portion of the periphery of the hole 412 corresponding thereof. The rear edge of each of the first positioning protrusions 452 faces the hole 412 corresponding thereto. Each of the first positioning protrusions 452 of the present embodiment protrudes downward in the up-down direction.

Referring to FIGS. 4 and 5, the first positioning protrusions 452 of the present embodiment are brought into abutment with the first positioned portions 332, respectively, in the front-rear direction. More specifically, a rear end of each of the first positioning protrusions 452 is brought into abutment with the first positioned portion 332 corresponding thereto in the front-rear direction.

Referring to FIGS. 2, 4, 5 and 6, each of the second positioning protrusions 456 of the present embodiment is formed on the second face 420 of the shell 400. Each of the second positioning protrusions 456 of the present embodiment protrudes upward in the up-down direction. The second positioning protrusions 456 correspond to the first positioning protrusions 452, respectively. Each of the second positioning protrusions 456 is positioned below the first positioning protrusion 452 corresponding thereto in the up-down direction. Each of the second positioning protrusions 456 is positioned at a position same as that of the first positioning protrusion 452 corresponding thereto in the second direction.

Referring to FIGS. 4 and 5, the second positioning protrusions 456 of the present embodiment are brought into abutment with the second positioned portions 336, respectively, in the front-rear direction. More specifically, a rear end of each of the second positioning protrusions 456 is brought into abutment with the second positioned portion 336 corresponding thereto in the front-rear direction.

Referring to FIGS. 2, 4 and 5, the connector 100 of the present embodiment is configured so that the second positioning protrusions 456 are visible through the holes 412, respectively, when the shell 400 is viewed alone. In other words, when the shell 400 is viewed alone, each of the second positioning protrusions 456 is visible through the hole 412 corresponding thereto. Specifically, when the shell 400 is viewed alone, each of the second positioning protrusions 456 is visible through the hole 412 which the first positioning protrusion 452 corresponding thereto faces. Accordingly, deviations of positions of the positioning protrusions 450 in the mating direction, or in the front-rear direction, can be checked through the holes 412 of the shell 400. More specifically, in the connector 100 of the present embodiment, when the shell 400 is viewed alone, the second positioning protrusions 456 are visible through holes 412, respectively, from above and behind the shell 400 so that the deviations of the positions of the positioning protrusions 450 in the front-rear direction can be checked through the holes 412 of the shell 400. In addition, the present invention is not limited thereto. But, at least one of the second positioning protrusions 456 should be visible through the hole 412 when the shell 400 is viewed alone.

Figure 6:
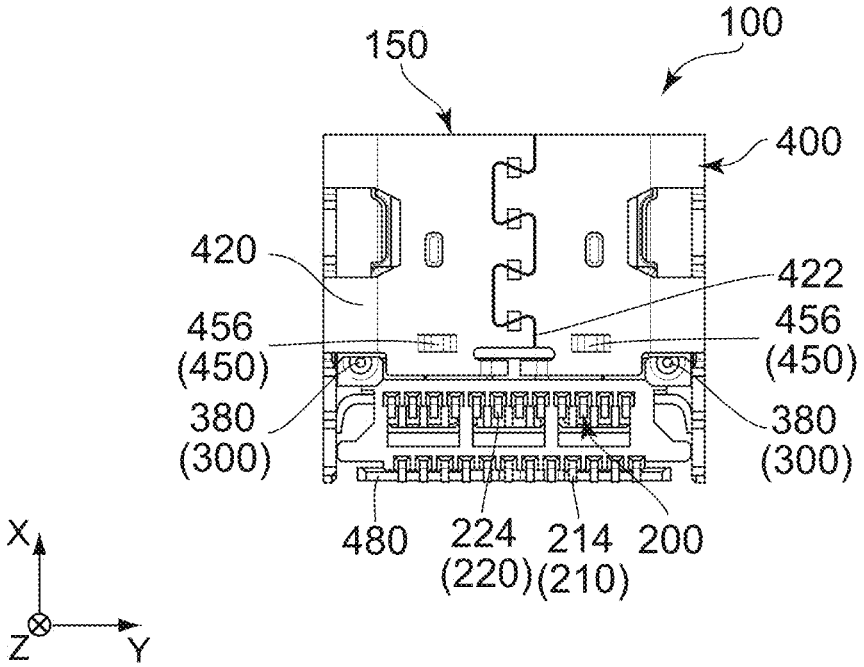
FIG. 6 is a bottom view showing the connector of FIG. 1.

As shown in FIG. 6, the joint 422 of the present embodiment is formed on the second face 420 of the shell 400. In other words, the second face 420 of the shell 400 has the joint 422. The joint 422 is positioned around a middle of the second face 420 of the shell 400 in the second direction and meanders in the front-rear direction. The joint 422 couples a positive Y-side part of the second face 420 of the shell 400 and a negative Y-side part thereof with each other. In the second direction, the joint 422 is put between the second positioning protrusions 456 so that the second positioning protrusions 456 are positioned at opposite sides, respectively, of the joint 422.

Referring to FIGS. 1, 3, 4 and 5, the holding lugs 470 of the present embodiment correspond to the holes 412, respectively. Each of the holding lugs 470 of the present embodiment extends in the corresponding hole 412 from the closed periphery of the corresponding hole 412. More specifically, in the second direction, each of the holding lugs 470 of the present embodiment extends inward in the corresponding hole 412 from an outer edge of the periphery of the corresponding hole 412. An inner end of the holding lug 470 in the second direction is a free end. In the front-rear direction, each of the holding lugs 470 is positioned rearward of the first positioning protrusion 452 which faces the hole 412 corresponding thereto. The holding lugs 470 correspond to the holding lug accommodating portions 350, respectively, of the main portion 320 of the holding member 300. In the up-down direction, each of the holding lugs 470 is spaced apart from and faces the slope 352 of the holding lug accommodating portion 350 corresponding thereto. The inner end of each of the holding lugs 470 in the second direction is accommodated in the holding lug accommodating portion 350 corresponding thereto.

Figure 3:
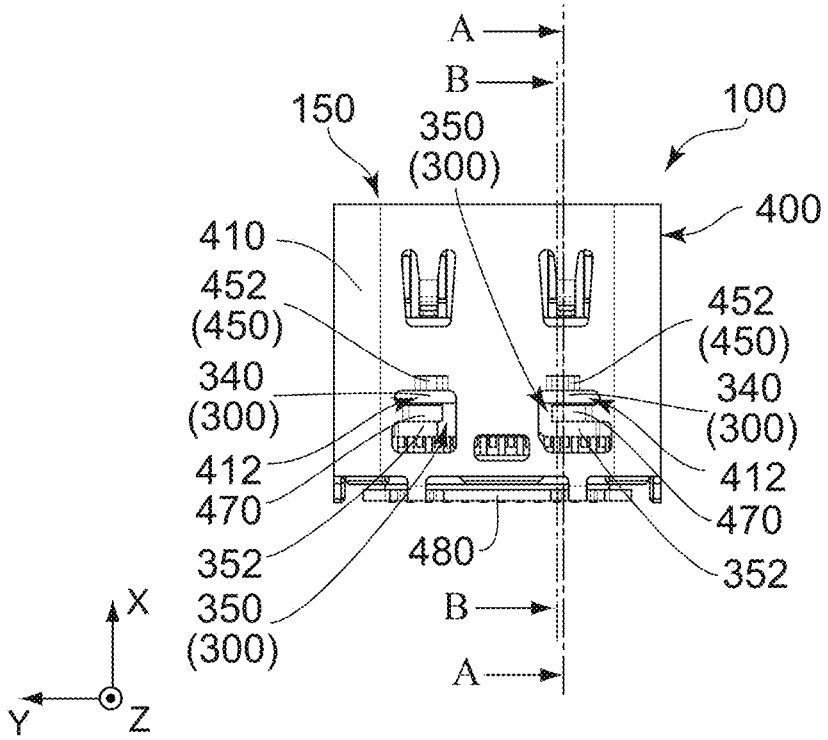
FIG. 3 is a top view showing the connector of FIG. 1.

Referring to FIGS. 3, 4 and 5, the held portion 340 of the holding member 300 is interposed between the holding lug 470 and the first positioning protrusion 452 in the mating direction, or in the front-rear direction. More specifically, the front surfaces of the held portions 340 of the holding member 300 are brought into contact with the rear ends of the first positioning protrusions 452, respectively, of the shell 400 in the front-rear direction, while the rear surfaces of the held portions 340 of the holding member 300 are brought into contact with front ends of the holding lugs 470, respectively, of the shell 400 in the front-rear direction. Accordingly, the shell 400 is fixed to the holding member 300 so as to be immovable relative thereto in the mating direction, or in the front-rear direction.

As shown in FIGS. 3 to 5, the rear wall 480 of the present embodiment has a substantially flat plate shape perpendicular to the front-rear direction. The rear wall 480 extends downward from a rear end of the first face 410 of the shell 400. The rear wall 480 is positioned rearward of the main portion 320 of the holding member 300 in the front-rear direction.

A method of attaching the holding member 300 to the shell 400 is described below.

Figure 7:
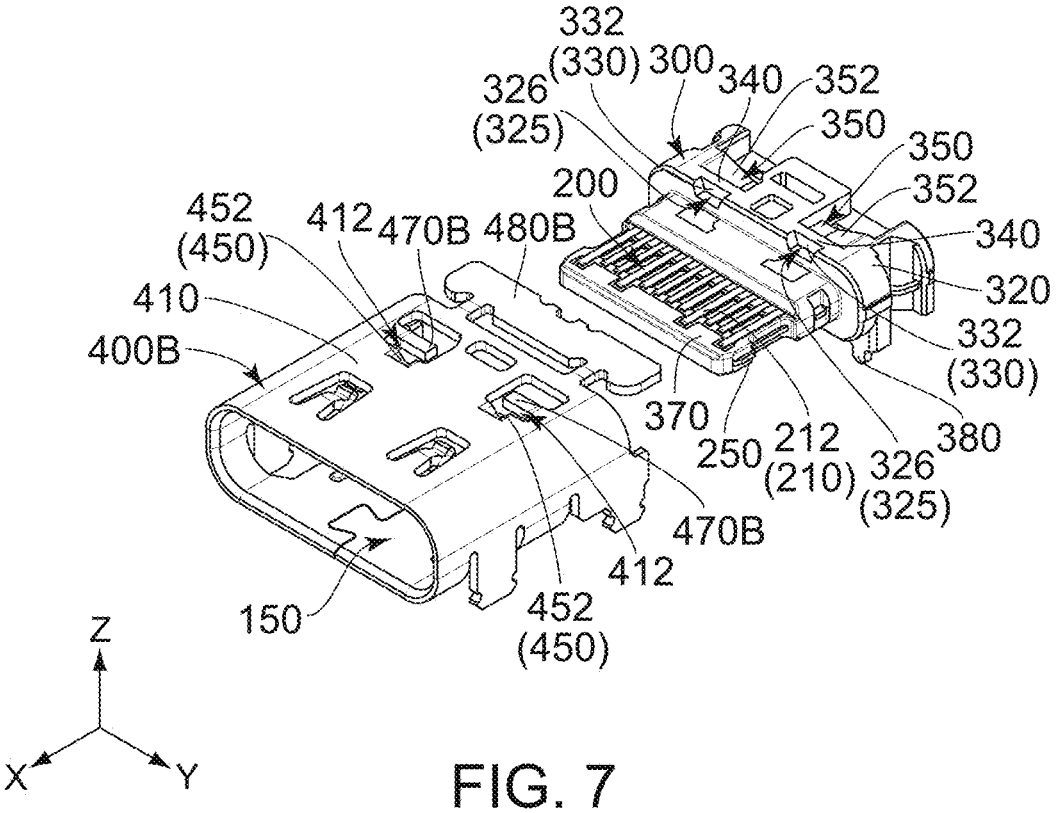
FIG. 7 is an exploded, perspective view showing the connector of FIG. 1.
Figure 8:
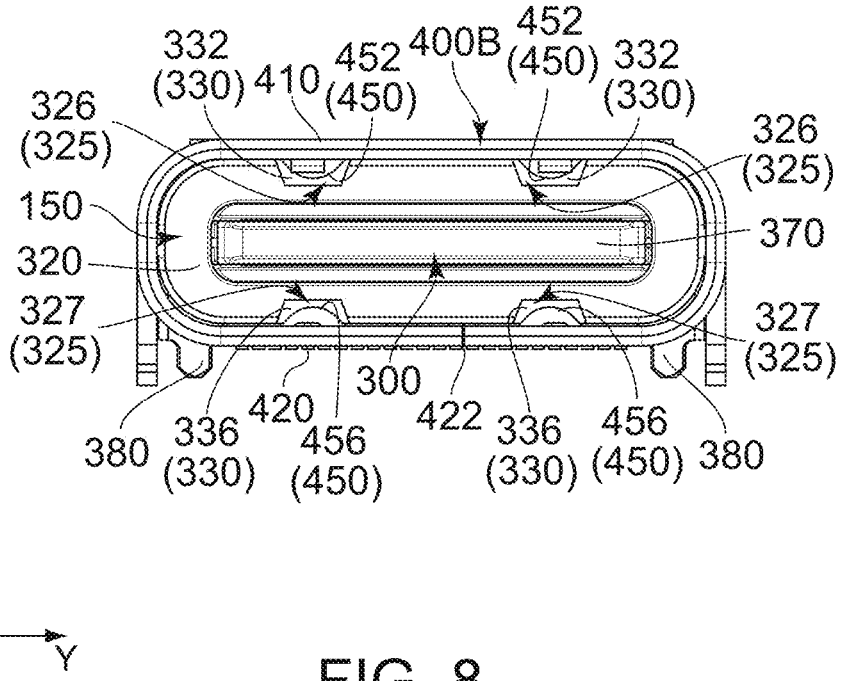
FIG. 8 is a front view showing the connector of FIG. 7.

At first, referring to FIGS. 7 and 8, an intermediate body member 400B, which has a structure similar to that of the shell 400 except that each of a rear wall 480B and holding lugs 470B is not bent, is prepared. Next, the holding member 300 is arranged rearward of the intermediate body member 400B so that the positioned portions 330 of the holding member 300 face positioning protrusions 450, respectively, of the intermediate body member 400B in the mating direction, or in the front-rear direction. After that, when the holding member 300 is moved forward along the front-rear direction, the tongue portion 370 of the holding member 300 is accommodated inside the intermediate body member 400B and the positioned portions 330 of the holding member 300 are brought into abutment with rear ends of the positioning protrusions 450, respectively, of the intermediate body member 400B in the front-rear direction.

The holding lugs 470 are formed by an inner end of each of the holding lugs 470B of the intermediate body member 400B in the second direction being pushed downward under this state. Accordingly, the holding lug 470 of the intermediate body member 400B is spaced apart from and faces the slope 352 of the holding lug accommodating portion 350, and the inner end of the holding lug 470 of the intermediate body member 400B in the second direction is accommodated in the holding lug accommodating portion 350 of the holding member 300.

Meanwhile, the held portion 340 of the holding member 300 is interposed between the holding lug 470 and the first positioning protrusion 452 in the mating direction, or in the front-rear direction. Specifically, the intermediate body member 400B is fixed to the holding member 300 so as to be immovable relative thereto in the front-rear direction. In this state, when the rear wall 480B of the intermediate body member 400B is bent downward to become the rear wall 480 so that the shell 400 is formed, a rear end of an upper part of the main portion 320 of the holding member 300 faces the rear wall 480 of the shell 400 in the front-rear direction. Accordingly, the holding member 300 is further prevented from being pulled rearward from the shell 400.

The structure of connector 100 is not limited thereto. For example, the connector 100 can be modified as described below.

Referring to FIGS. 12 to 15, a connector 100A according to a modification of the present embodiment comprises a holding member 300A, a plurality of contacts 200, a midplate 250 and a shell 400A. The contact 200 and the midplate 250 have shapes same as the contact 200 and the midplate 250 of the aforementioned embodiment. Accordingly, portions which are same as those of the contact 200 and the midplate 250 of the aforementioned embodiment are referred by using reference signs same as those of the contact 200 and the midplate 250 of the aforementioned embodiment, and a detailed explanation about the portions is omitted.

Referring to FIGS. 12 to 15, the holding member 300A of the present modification is attached and fixed to the shell 400A. A method of attaching the holding member 300A to the shell 400A is similar to the method of attaching the holding member 300 of the aforementioned embodiment to the shell 400 thereof. Accordingly, a detailed explanation thereabout is omitted.

Referring to FIGS. 12 to 15, the holding member 300A of the present embodiment is made of insulator. The holding member 300A has a main portion 320A, a tongue portion 370 and two leg portions 380. The tongue portion 370 has a flat plate shape. Components of the holding member 300A except for the main portion 320A are same as those of the aforementioned embodiment. Accordingly, the components which are same as those of the aforementioned embodiment are referred by using reference signs same as those of the aforementioned embodiment, and a detailed explanation thereabout is omitted.

Referring to FIGS. 12 to 15, when the holding member 300 is viewed from the front thereof, the main portion 320A of the present embodiment has a rounded rectangular shape which has two linear sides and two arc-shaped sides. The two linear sides of the rounded rectangular shape of the main portion 320A face each other in the up-down direction. The two arc-shaped sides of the rounded rectangular shape of the main portion 320A face each other in the second direction. The main portion 320A of the present embodiment has a block-like shape extending long in the second direction.

Figure 13:
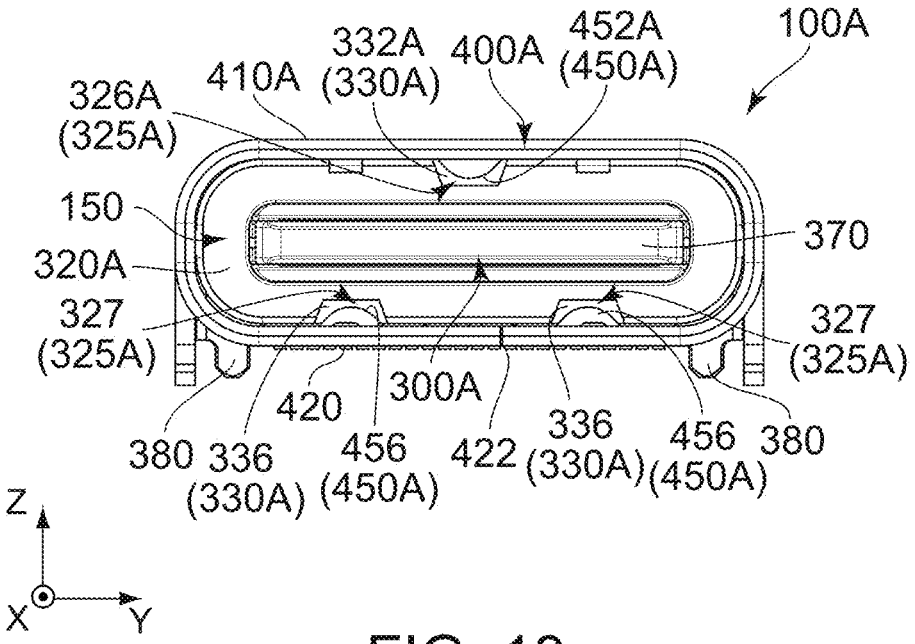
FIG. 13 is a front view showing the connector of FIG. 12.
Figure 14:
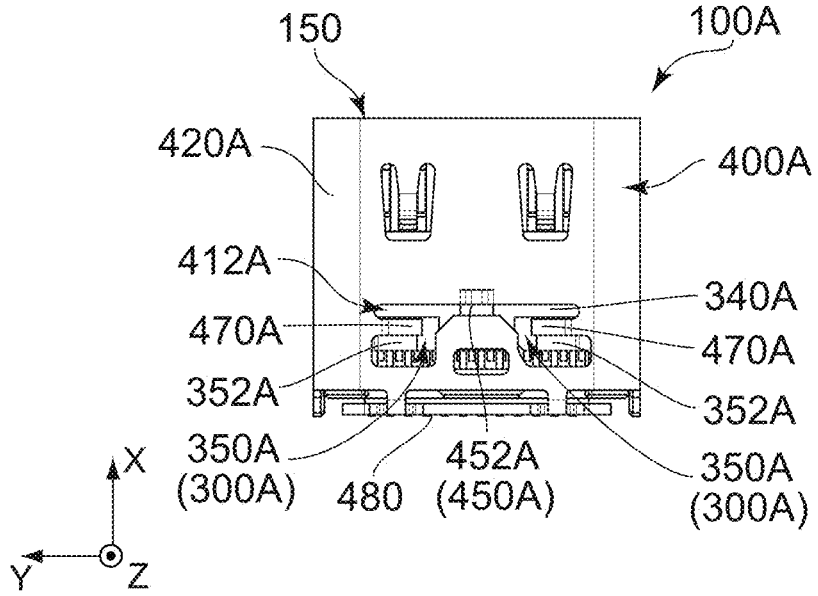
FIG. 14 is a top view showing the connector of FIG. 12.
Figure 15:
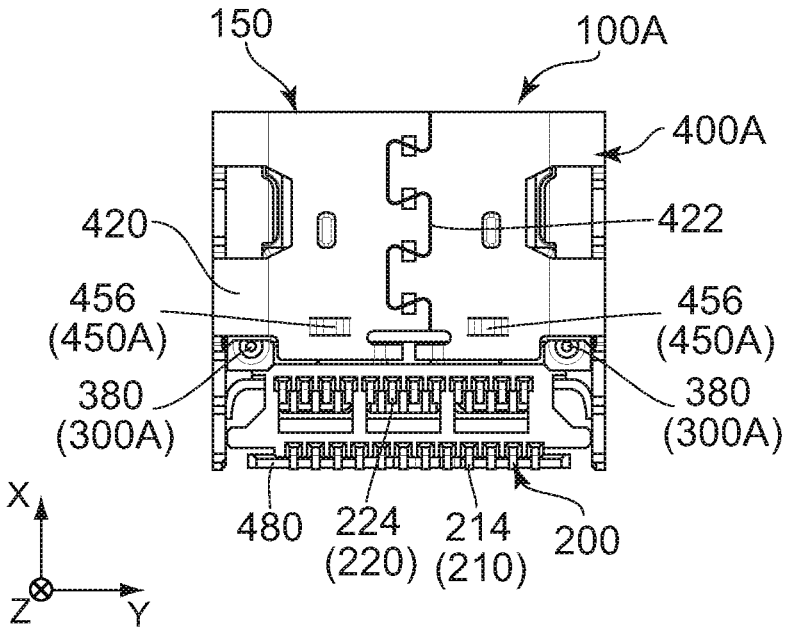
FIG. 15 is a bottom view showing the connector of FIG. 12.
Figure 16:
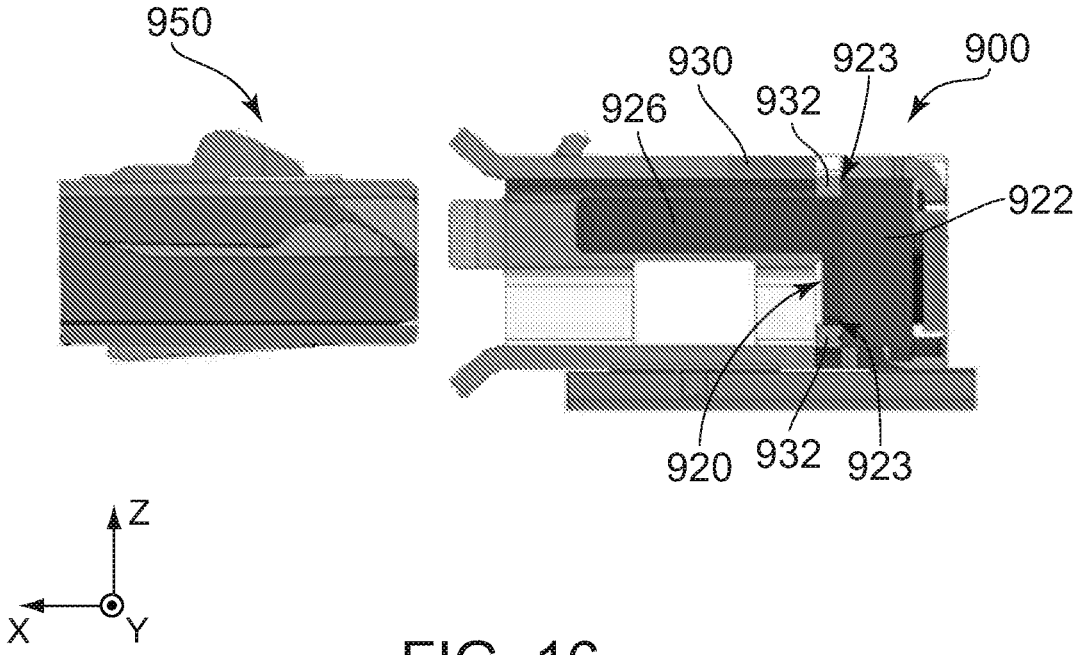
FIG. 16 PRIOR ART
FIG. 16 is a cross-sectional view showing a connector and a mating connector of Patent Document 1.
Figure 17:
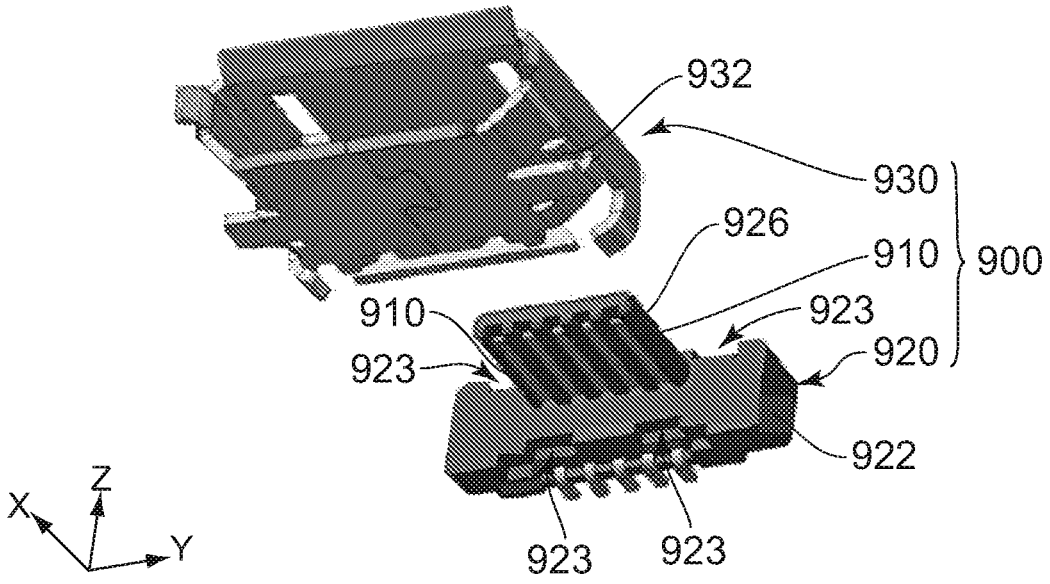
FIG. 17 PRIOR ART
FIG. 17 is an exploded, perspective view showing the connector of FIG. 16.

Referring to FIGS. 13 and 14, the main portion 320A of the present embodiment is provided with three recesses 325A, a held portion 340A and two holding lug accommodating portions 350A.

Referring to FIG. 13, each of the recesses 325A of the present embodiment is recessed rearward in the front-rear direction. Each of the recesses 325A has a rear wall perpendicular to the front-rear direction, and the rear wall functions as a positioned portion 330A. In other words, the main portion 320A of the present embodiment is provided with three of the positioned portions 330A. The three positioned portions 330A are positioned at positions same as each other in the mating direction, or in the front-rear direction. The three positioned portions 330A form a reference surface perpendicular to the front-rear direction. The tongue portion 370 of the present embodiment is perpendicular to the reference surface which is formed by the three positioned portions 330A.

As shown in FIG. 13, the recesses 325A of the present embodiment include a first recess 326A and two second recesses 327. Since the second recess 327 of the present modification is similar to the second recess 327 of the main portion 320 of the holding member 300 of the aforementioned embodiment, a detailed explanation thereabout is omitted. The first recess 326A is provided around a middle of the main portion 320A in the second direction. The first recess 326A is provided on an upper front end of the main portion 320A.

As shown in FIG. 13, the first recess 326A of the present embodiment has a first positioned portion 332A. Specifically, the positioned portions 330A of the present embodiment include the single first positioned portion 332A and two second positioned portions 336. The first positioned portion 332A is positioned above any of the second positioned portions 336 in the up-down direction. The first positioned portion 332A is positioned between the second positioned portions 336 in the second direction.

As shown in FIG. 14, the held portion 340A of the present embodiment has a substantially flat plate shape extending in the up-down direction. Specifically, the held portion 340A has a front surface and a rear surface in the front-rear direction. A part of the front surface of the held portion 340A functions as the first positioned portion 332A.

As shown in FIG. 14, each of the holding lug accommodating portions 350A of the present embodiment is recessed downward in the up-down direction. Each of the holding lug accommodating portions 350A has a slope 352A which extends downward and toward an inside of the main portion 320A in the second direction. Each of the holding lug accommodating portions 350A is positioned rearward of the held portion 340A in the front-rear direction.

The shell 400A of the present embodiment is made of metal. As understood from FIGS. 12 to 15, the shell 400A surrounds the holding member 300A in a plane perpendicular to the front-rear direction.

As shown in FIGS. 12 to 15, the shell 400A of the present embodiment has a first face 410A and a second face 420 which are opposite faces of the shell 400A in the up-down direction. Specifically, the first face 410A is an upper face 410A of the shell 400A, and the second face 420 is a lower face 420 of the shell 400A. Each of the first face 410A and the second face 420 is perpendicular to the up-down direction. A front end of the shell 400A of the present embodiment opens. In other words, the connector 100A has an opening 150 at its front end.

As shown in FIGS. 12 to 15, the shell 400A of the present embodiment is formed with a hole 412A and three positioning protrusions 450A. In addition, the shell 400A of the present embodiment is provided with a joint 422, two holding lugs 470A and a rear wall 480. Components of the shell 400A except for the hole 412A, the positioning protrusion 450A and the holding lug 470A are same as those of the aforementioned embodiment. Accordingly, the components which are same as those of the aforementioned embodiment are referred by using reference signs same as those of the aforementioned embodiment, and a detailed explanation thereabout is omitted.

Figure 12:
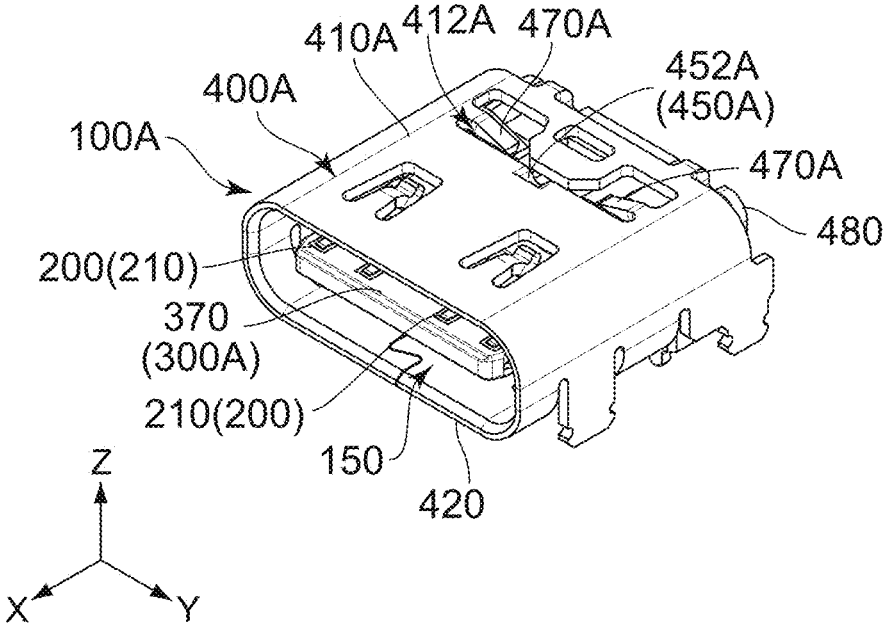
FIG. 12 is a perspective view showing a modification of the connector of FIG. 1.

As understood from FIGS. 12 and 14, the hole 412A of the present embodiment is formed on the first face 410A of the shell 400A. In other words, the first face 410A of the shell 400A is formed with the single hole 412A. The hole 412A has a closed periphery on a surface of the shell 400A. The hole 412A pierces the shell 400A in the first direction, or in the up-down direction. More specifically, the hole 412A has the closed periphery on a surface of the first face 410A of the shell 400A. The hole 412A pierces the first face 410A of the shell 400A in the up-down direction. An inner edge of the periphery of the hole 412A in the front-rear direction has a substantially linear shape extending in the second direction.

As understood from FIG. 13, each of the positioning protrusions 450A of the present embodiment protrudes inward of the shell 400A. More specifically, each of the positioning protrusions 450A of the present embodiment protrudes inward of the shell 400A in the up-down direction. The positioning protrusions 450A occupy zones, respectively, in the mating direction, or in the front-rear direction. The zones overlap with each other in the mating direction, or in the front-rear direction. More specifically, the positioning protrusions 450A are positioned at positions same as each other in the mating direction, or in the front-rear direction.

Referring to FIGS. 13 and 14, the positioning protrusions 450A of the present embodiment are brought into abutment with the positioned portions 330A of the recesses 325A, respectively, of the main portion 320A of the holding member 300A in the mating direction, or in the front-rear direction. More specifically, rear ends of the three positioning protrusions 450A and the three positioned portions 330A are positioned on a single YZ-plane in the front-rear direction. Since the tongue portion 370 is perpendicular to the reference surface which is formed by the three positioned portions 330A as described above, an attitude of the tongue portion 370 of the holding member 300A in the shell 400A can be appropriately fixed.

Referring to FIG. 13, the positioning protrusions 450A of the present embodiment include a first positioning protrusions 452A and two second positioning protrusions 456. Since the second positioning protrusions 456 of the present modification are similar to the second positioning protrusions 456 of the shell 400 of the aforementioned embodiment, and a detailed explanation thereabout is omitted.

Referring to FIGS. 12 and 14, the first positioning protrusion 452A of the present embodiment is formed on the first face 410A of the shell 400A. The first positioning protrusion 452A forms a part of the closed periphery of the hole 412A. The first positioning protrusion 452A faces the hole 412A. More specifically, a rear edge of the first positioning protrusion 452A forms a part of a front edge of the periphery of the hole 412A. The rear edge of the first positioning protrusion 452A faces the hole 412A. The first positioning protrusion 452A of the present embodiment protrudes downward in the up-down direction.

Referring to FIGS. 13 and 14, the first positioning protrusion 452A of the present embodiment is brought into abutment with the first positioned portion 332A in the front-rear direction. More specifically, a rear end of the first positioning protrusion 452A is brought into abutment with the first positioned portion 332A in the front-rear direction.

Referring to FIGS. 12 to 15, the connector 100A of the present embodiment is configured so that each of the second positioning protrusions 456 is visible through the hole 412A when the shell 400A is viewed alone. Accordingly, deviations of positions of the positioning protrusions 450A in the mating direction, or in the front-rear direction, can be checked through the hole 412A of the shell 400A. In addition, the present invention is not limited thereto. But, at least one of the second positioning protrusions 456 should be visible through the hole 412A when the shell 400A is viewed alone.

Referring to FIGS. 12 and 14, each of the holding lugs 470A of the present embodiment extends in the hole 412A from the closed periphery of the hole 412A. More specifically, in the second direction, each of the holding lugs 470A of the present embodiment extends inward in the hole 412A from an outer edge of the periphery of the hole 412A. An inner end of the holding lug 470A in the second direction is a free end. Each of the holding lugs 470A is positioned rearward of the first positioning protrusion 452A in the front-rear direction. The holding lugs 470A correspond to the holding lug accommodating portions 350A, respectively, of the main portion 320A of the holding member 300A. In the up-down direction, each of the holding lugs 470A is spaced apart from and faces the slope 352A of the holding lug accommodating portion 350A corresponding thereto. The inner end of each of the holding lugs 470A in the second direction is accommodated in the holding lug accommodating portion 350A corresponding thereto.

As shown in FIG. 14, the held portion 340A of the holding member 300A is interposed between the holding lug 470A and the first positioning protrusion 452A in the mating direction, or in the front-rear direction. More specifically, the part of the front surface of the held portion 340A of the holding member 300A is brought into contact with the rear end of the first positioning protrusion 452A of the shell 400A in the front-rear direction, while parts of the rear surface of the held portion 340A of the holding member 300A are brought into contact with front ends of the holding lugs 470A, respectively, of the shell 400A in the front-rear direction. Accordingly, the shell 400A is fixed to the holding member 300A so as to be immovable relative thereto in the mating direction, or in the front-rear direction.

Although the specific explanation about the present invention is made above referring to the embodiments, the present invention is not limited thereto and is susceptible to various modifications and alternative forms.

Although the connector 100, 100A of the present embodiment is configured so that the mating direction is the front-rear direction while the first direction is the up-down direction, the present invention is not limited thereto. The mating direction may be the up-down direction, and then the first direction should be perpendicular to the mating direction.

Although the shell 400, 400A of the connector 100, 100A of the present embodiment is provided with the two holding lugs 470, 470A, the present invention is not limited thereto. Specifically, the number of the holding lug may be one, provided that the shell is rigidly fixed to the holding member.

Although the holding lug 470, 470A of the shell 400, 400A of the connector 100, 100A of the present embodiment extends in the hole 412, 412A which the first positioning protrusion 452, 452A faces, the present invention is not limited thereto. A hole, which the first positioning protrusion faces, and a hole, in which the holding lug extends, may be independent and separated from each other.

Although the first contact 210 and the second contact 220 of the contacts 200 of the connector 100, 100A of the present embodiment have the first contact portion 212 and the second contact portion 222 each having the plate-like shape, the present invention is not limited thereto. Each of the first contact portion and the second contact portion may be a contact spring.

Although the first face 410A of the shell 400A of the connector 100A of the present modification is provided with the single hole 412A and the single first positioning protrusion 452A, the present invention is not limited thereto. Specifically, the first face of the shell may be provided with the single hole and two of the first positioning protrusions.

The present application is based on a Japanese patent application of JP2017-195058 filed before the Japan Patent Office on Oct. 5, 2017, the content of which is incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

REFERENCE SIGNS LIST

100, 100A connector
150 opening
200 contact
210 first contact
212 first contact portion
214 first fixed portion
220 second contact
222 second contact portion
224 second fixed portion
250 midplate
300, 300A holding member
320, 320A main portion
325, 325A recess
326, 326A first recess
327 second recess
330, 330A positioned portion
332, 332A first positioned portion
336 second positioned portion
340, 340A held portion
350, 350A holding lug accommodating portion
352, 352A slope
370 tongue portion
372 contact portion exposed portion
374 connecting portion
380 leg portion
400, 400A shell
400B intermediate body member
410, 410A first face (upper face)
412, 412A hole
420 second face (lower face)
422 joint
450, 450A positioning protrusion
452, 452A first positioning protrusion
456 second positioning protrusion
470, 470A, 470B holding lug
480, 480B rear wall

The invention claimed is:

1. A connector mateable with a mating connector along a mating direction, wherein:

the connector comprises a plurality of contacts, a holding member and a shell;

the holding member holds the plurality of contacts;

the holding member has a main portion and a tongue portion;

the tongue portion has a flat plate shape;

the main portion is provided with three or more positioned portions;

the tongue portion extends in the mating direction from the main portion;

the shell surrounds, at least in part, the holding member in a plane perpendicular to the mating direction;

the shell is formed with a hole and three or more positioning protrusions;

the hole has a closed periphery on a surface of the shell;

the hole pierces the shell in a first direction perpendicular to the mating direction;

each of the positioning protrusions protrudes inward of the shell;

the positioning protrusions occupy zones, respectively, in the mating direction, the zones overlapping with each other in the mating direction;

the positioning protrusions are brought into abutment with the positioned portions, respectively, in the mating direction;

the positioning protrusions include a first positioning protrusion and two second positioning protrusions;

the first positioning protrusion forms a part of the closed periphery of the hole;

the first positioning protrusion faces the hole; and when the shell is viewed alone, at least one of the second positioning protrusions is visible through the hole.

2. The connector according to claim 1, wherein the positioning protrusions are positioned at positions same as each other in the mating direction.

3. The connector according to claim 1, wherein:

the shell has a first face and a second face which are opposite faces of the shell in the first direction;

each of the hole and the first positioning protrusion is formed on the first face of the shell;

each of the second positioning protrusions is formed on the second face of the shell;

the second face of the shell has a joint;

in a second direction perpendicular to both the mating direction and the first direction, the joint is put between the second positioning protrusions so that the second positioning protrusions are positioned at opposite sides, respectively, of the joint; and when the shell is viewed alone, each of the second positioning protrusions is visible through the hole.

4. The connector according to claim 3, wherein:

the first face of the shell is formed with two of the holes;

the positioning protrusions include two of the first positioning protrusions;

each of the first positioning protrusions is formed with the first face of the shell;

the first positioning protrusions face the holes, respectively; and when the shell is viewed alone, the second positioning protrusions are visible through the holes, respectively.

5. The connector according to claim 1, wherein:

the holding member is provided with a held portion;

the shell is provided with a holding lug;

the holding lug extends in the hole from the closed periphery of the hole; and the held portion is interposed between the holding lug and the first positioning protrusion in the mating direction.

6. The connector according to claim 1 , wherein:

the mating direction is a front-rear direction;

the first direction is an up-down direction;

the first face is an upper face; and the second face is a lower face.

* * * * *